United States Patent [19]

Burton

[11] 4,187,865

[45] Feb. 12, 1980

[54] CIGARETTE CLIPPER

[76] Inventor: Johnny A. Burton, 1440 S. West Blvd., Rohnert Park, Calif. 94928

[21] Appl. No.: 956,262

[22] Filed: Oct. 30, 1978

[51] Int. Cl.[2] ..... A24F 13/24

[52] U.S. Cl. ..... 131/250; 83/609; 30/112; 144/193 C

[58] Field of Search ..... 131/250, 248, 250.1; 83/607-609, 562; 30/112; 144/193 C

[56] References Cited

U.S. PATENT DOCUMENTS

| | | | |
|---|---|---|---|
| 293,404 | 2/1884 | Bird | 131/250 |
| 447,615 | 3/1891 | Lewis | 131/250 |
| 717,223 | 12/1902 | Leachman | 83/609 |
| 848,057 | 3/1907 | Seckendorff | 83/609 |

*Primary Examiner*—Stephen C. Pellegrino
*Attorney, Agent, or Firm*—Melvin R. Stidham

[57] ABSTRACT

A cigarette clipping device comprising an open ended casing, sized and shaped to accommodate a standard package of cigarettes. A knife edge is pivoted and slidably carried along one side of the casing and is received in any one of a plurality of parallel slots through the casing so that by pivoting the knife through a selected slot, the length of a cigarette package and, hence, the cigarettes therein, are reduced by a predetermined amount.

5 Claims, 3 Drawing Figures

CIGARETTE CLIPPER

BACKGROUND OF THE INVENTION

Many people who have acquired the cigarette smoking habit are desirous of stopping. Often such people discontinue smoking abruptly, only to discover that the urge is so great that they soon found themselves overcome by the desire to smoke and, are unable to continue abstinence.

OBJECTS OF THE INVENTION

It is an object of this invention to provide a means for breaking the smoking habit by gradual withdrawal from full smoking practice.

It is a further object of this invention to provide a means for breaking the smoking habit by providing for a gradually decreasing amount of tobacco with each smoking occurence.

Other objects and advantages of this invention will become apparent from the description to follow, particularly when read in conjunction with the accompanying drawing.

SUMMARY OF THE INVENTION

In carrying out this invention, I provide a casing of a size and shape in cross section to receive a standard pack of cigarettes closely. A plurality of parallel slots are cut through the casing starting from one end thereof, with each slot representing an increment of length to which the cigarettes may be shortened. A rail shaft is disposed along one side of the casing and a lever having a knife edge at the bottom thereof is slidably and rotatably carried on the rail. A pack of cigarettes may be inserted into the casing with the bottom thereof disposed at the end from which the slots commence and then the lever is moved along to the desired slot representative of the length of cigarette to be removed. The lever is then pivoted down and through the pack of cigarettes severing a length from the bottom thereof and then the severed package is pushed from the casing. The bottom portion is discarded and a film or sheet having adhesive along the edges thereof is placed over the exposed cigarettes at the bottom and adhered to the faces and sides of the cigarette pack. Then the top of the package may be opened and the cigarettes smoked as usual but, of course, each cigarette will be shorter by a predetermined amount. Subsequent packages may be severed even further until the amount of cigarette smoked each time decreases to the point where total abstinence is facilitated.

DESCRIPTION OF A PREFERRED EMBODIMENT

Figure 1:
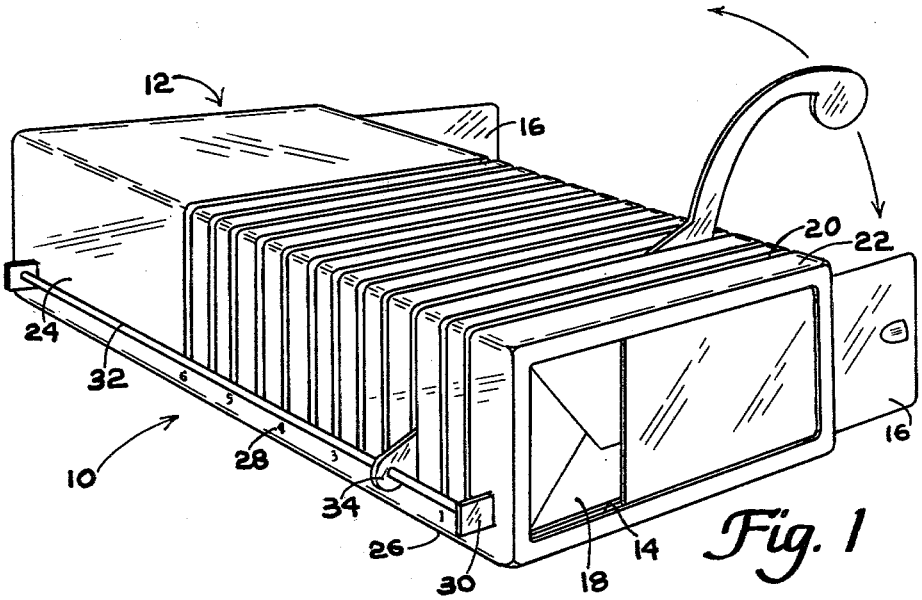
FIG. 1 is a view in perspective of the cigarette clipping device of this invention.
Figure 2:
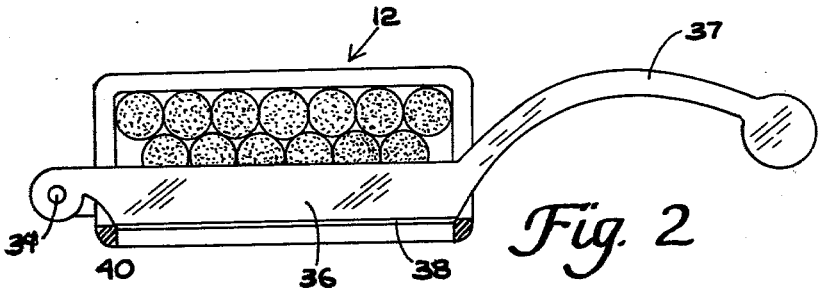
FIG. 2 is a section view of the casing and severing knife.
Figure 3:
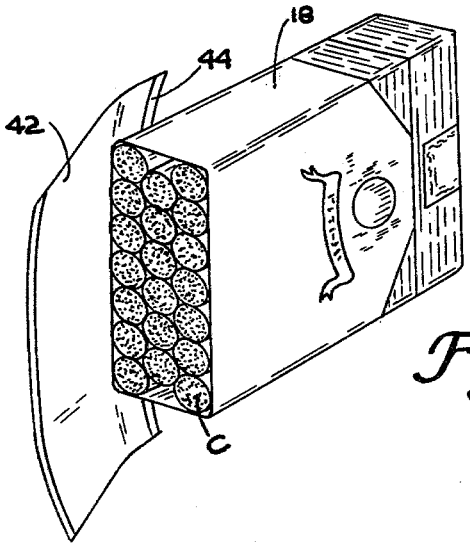
FIG. 3 is a view in perspective of a severed package.

Referring now to the drawing with greater particularity, the cigarette clipper of this invention 10 comprises a casing 12 of a relatively rigid material such as a suitable plastic or metal. The casing is open at 14 at both ends and, if desired, cover panels 16 may be provided to slide over the ends of the cigarette package 18 inserted therein from one open end. Extending across the casing 12 is a plurality of parallel slots 20 which extend completely across the top of the casing 22 and down the sides 24 almost to the bottom 26. Preferably, the slots 20 are marked as indicated at 28 to indicate the increments of length. For example, the slots may be one-half centimeter apart so that every other slot represents a centimeter to be severed from the cigarettes. Mounted between brackets 30 extending from one side 24 of the casing 12 is a rail shaft 32, and slidably and rotatably received therein is one end 34 of a lever 36 having a handle 37 extending from one end thereof and a knife edge 38 along the bottom, the knife edge being received in exit slots 40 formed substantially across the bottom of the casing 12. In operation, the cigarette is inserted at one end of the casing with the bottom of the package disposed toward the slotted end to avoid severing or damaging filter tips which are normally carried at the upper end of the package 18. Then, the lever 36 is moved to the particular slot 20 which provides the desired amount of reduction and is then pivoted through to sever the bottom of the package by that amount. The package is then pushed out either open end and the bottom thereof discarded and replaced by a sheet or film 42 which has adhesive 44 along just the side edges thereof. Hence, the sheet may be placed over the severed end with no adhesive being exposed to the cigarettes C contained therein and adhesive applied to the faces and sides of the package to retain the cigarettes. The other end is then opened and the cigarettes smoked as desired.

As subsequent packs of cigarettes are acquired they are severed in the same manner, but by progressively increasing amounts. After four or five stages the cigarettes will be reduced to lengths where the amount of nicotine is not sufficient to reach a havit level.

While this invention has been described in conjuntion with a preferred embodiment thereof, it is obvious that modifications and changes therein may be made by those skilled in the art without departing from the spirit and scope of this invention, as defined by the claims appended tereto.

What is claimed as invention is:

1. A cigarette clipping device comprising:

an open-ended casing of relatively rigid material and of a size and shape in cross-section to accommodate closely a package of cigarettes;

a plurality of parallel main slots in said casing from adjacent one end thereof, each of said main slots extending fully across the top of said casing and from said top down both sides thereof to levels near the bottom thereof;

a rail shaft mounted along one of said sides parallel to and adjacent the bottom of said casing;

a lever slidably and rotatably carried at one end thereof on said rail shaft and extending beyond the other of said sides; and a knife edge along the bottom of said lever.

2. The cigarette clipping device defined by claim 1 including:

a plurality of exit slots aligned with said main slots and extending almost completely across the bottom of said casing.

3. The cigarette clipping device defined by claim 1 including:

a scale along said one side of the casing below certain of said slots to indicate the spacing thereof from the end of the casing.

4. The cigarette clipping device defined by claim 1 including:

slide panels to close the ends of said casing.

5. The cigarette clipping device defined by claim 1 including:

a sheet to cover the severed end of a package of cigarettes having adhesive along just the side edges thereof.

* * * * *